United States Patent [19]

Hocker et al.

[11] 4,228,928

[45] Oct. 21, 1980

[54] BOTTLE WITH A CLIP FOR SUSPENDING THE BOTTLE IN INVERTED POSITION

[75] Inventors: Harvey L. Hocker, Fort Bragg; John M. Alcamo, Modesto, both of Calif.

[73] Assignee: Northwest Sanitation Products, Inc., Fort Bragg, Calif.

[21] Appl. No.: 954,362

[22] Filed: Oct. 25, 1978

[51] Int. Cl.[3] ..... B65D 25/22; B67D 5/06

[52] U.S. Cl. ..... 222/181; 4/228; 16/191; 215/100 R; 220/18; 248/215; 248/360; 403/113

[58] Field of Search ..... 222/180, 181; 215/100 R, 100 A; 4/227, 228; 248/215, 311.3, 359, 360; 220/18; 16/191; 403/113, 117

[56] References Cited

U.S. PATENT DOCUMENTS

| | | | |
|---|---|---|---|
| 3,841,524 | 10/1974 | Easter | 4/227 X |
| 3,883,024 | 5/1975 | Thomas | 222/181 X |
| 3,935,956 | 2/1976 | Sansanelli | 215/100 R |
| 4,101,043 | 7/1978 | Johnson, Jr. et al. | 215/100 R |

*Primary Examiner*—David A. Scherbel
*Assistant Examiner*—Fred A. Silverberg
*Attorney, Agent, or Firm*—Owen, Wickersham & Erickson

[57] ABSTRACT

A bottle suspending device primarily for a toilet cleaner dispenser bottle for use in a toilet tank. A pivotal member is received in a recess of the bottle's sidewall when stored and is swingable outwardly to an extended position for resting over the top of the toilet tank wall when the bottle is inverted. The pivotal member has a pair of protruding nipples which are press fit upon assembly onto a pair of corresponding sockets in the recess of the bottle wall, so that the pivotal member rotates from its stored position through about 90° to its extended position along a horizontal pivot axis near the upper end of the suspended inverted bottle. A pair of stop ribs on the pivotal member near the pivot axis abut against the dispenser bottle walls when the pivotal member is extended, to prevent rotation beyond the extended position, and structure associated with the recess provides further protection against over-pivoting. A lip at the other end of the pivotal member grips the edge of the toilet tank wall to maintain the bottle in its intended inverted position.

10 Claims, 4 Drawing Figures

FIG. 1
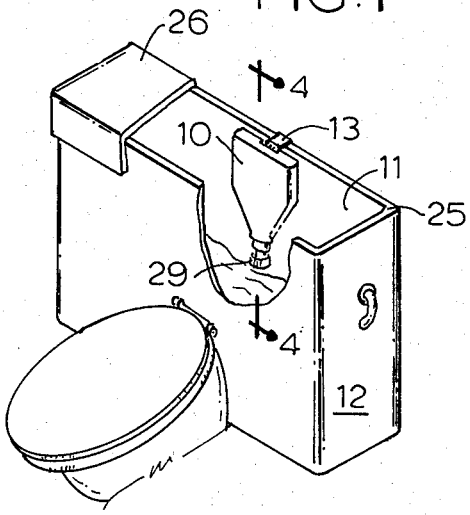
FIG. 2
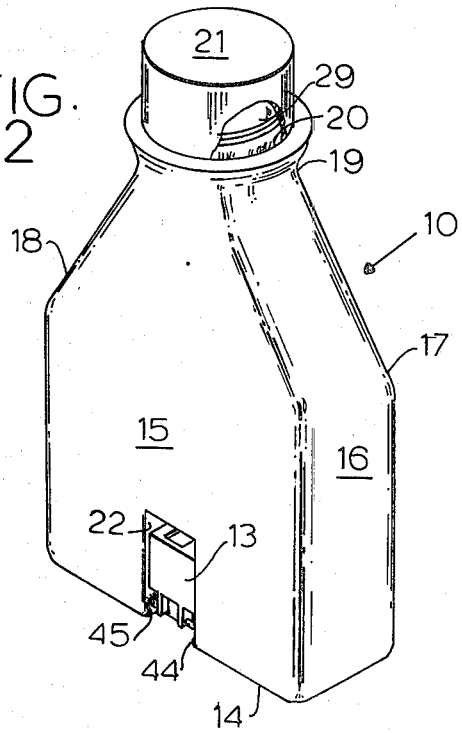
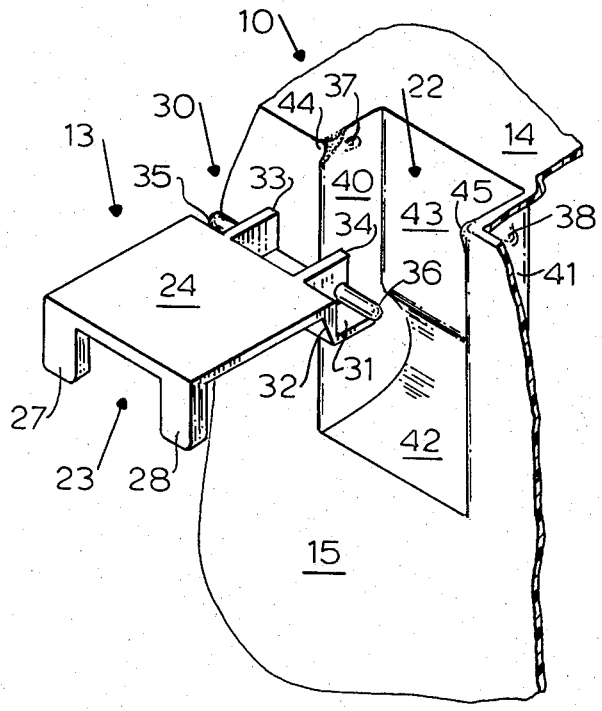
FIG. 3
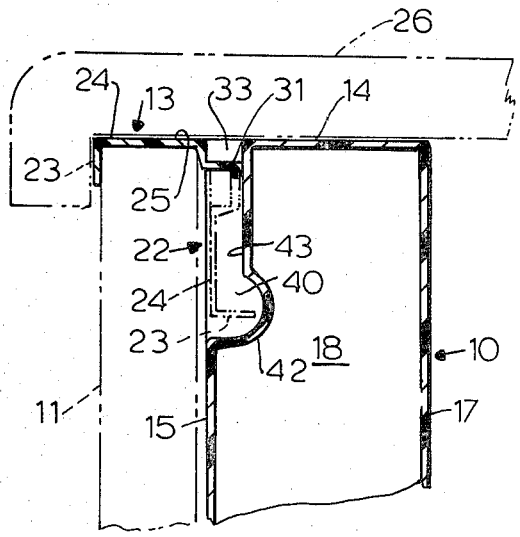
FIG. 4

BOTTLE WITH A CLIP FOR SUSPENDING THE BOTTLE IN INVERTED POSITION

BACKGROUND OF THE INVENTION

This invention relates to a bottle having a clip for suspending the bottle in an inverted position. It relates particularly to bottles that are used to dispense detergent into a toilet tank.

A number of types of suspending devices for liquid dispensers have been suggested. For example, see U.S. Pat. No. 2,839,763, showing a hook-type suspension device which is positioned over the top of a toilet tank wall and which clamps onto the neck of the bottle. U.S. Pat. No. 3,023,426 shows another type of fixed hook member supporting a cage basket into which the bottle fits. U.S. Pat. No. 3,769,640, shows bendable wires forming a hanging device. These devices are all cumbersome, involve hangers that are separate entities from the bottle, and complicate installation. Also, they are relatively expensive.

U.S. Pat. Nos. 3,627,177, 3,698,021, 3,864,793, and 3,952,339, show devices which are assembled with the bottle. These involve a sliding member, usually metal, that slides in a recess in the bottom wall of the bottle, and requires stops. They are somewhat tricky to assemble and tend to be stiff in their action.

U.S. Pat. No. 3,841,524 to Easter disclosed pivotal dispenser bottle hanger including a flexible plastic hanger member secured permanently to the bottle wall, within a shaped recess, by suitable bonding means. The hanger member had a grooved fold line so that it could pivot to be rotated outwardly 90° from a stored position to an extended, bottle-suspending position. This risked being broken off by flexure.

While these prior devices were for the most part effective for their intended purpose, none was as efficient, dependable, easy to use, and as economically manufactured and assembled as the present invention described below.

SUMMARY OF THE INVENTION

The bottle hanger of the present invention is simple in manufacture, assembly, and operation, yet at least as effective and dependable as prior devices in service. A single hanger component is required, and in assembly it is simply snapped into place in the dispenser bottle wall, with no gluing or other type of adhereing or fastener means required. In storage prior to use, the bottle retains the hanger closely against its side, contained in a recess and generally flush with the remainder of the bottle wall. The shape of the hanger member is such that it enables pivotal movement through 90° only, from the stored position to an extended position generally parallel and flush with the bottle's bottom.

In addition, protruding structure on the recess walls of the bottle interferes with over-rotation, beyond the 90° extended position, to further prevent forced rotation beyond the intended position.

In use, the hanger rests on the top edge of a wall member, such as the wall of a toilet tank, so that the bottom of the inverted bottle does not extend appreciably higher than the hanger itself. In the case of a toilet tank, this avoids interference with tank top closure. To retain the bottle in position against the wall member, a lip or flange on the end of the hanger member extends downwardly over the edge of the wall member.

Accordingly, in an embodiment a suspending device according to the invention for an inverted dispenser bottle comprises a hanger member for suspending the bottle over the top of a wall member against which the bottle is to be positioned; means associated with the hanger member and a wall of the bottle for pivotally mounting the hanger member on the bottle such that the hanger member rotates about a horizontal axis at a pivoted end, from a stored position adjacent the bottle wall to an outwardly extended position generally perpendicular to the bottle wall, said axis being near the upper end of the suspended bottle; means for limiting the outward rotation of the hanger member to said generally perpendicular extended position; lip means on the outer end of the hanger member, opposite said pivoted end, extending toward the bottle wall when the hanger member is stored, for holding the bottle close to said wall member, limiting movement of the bottle's upper end; and recess means in the bottle wall providing for substantially flush storage of the hanger member in the bottle wall.

As discussed above, among the objects of the invention is to provide a simple yet efficient dispenser bottle suspending device which is easily and quickly assembled, which may be stored compactly with the bottle, and which is easily operated and dependable in service. These and other objects, advantages, and features of the invention will be apparent from the following description of a preferred embodiment, taken in conjunction with the drawing.

DESCRIPTION OF THE DRAWINGS

In the drawings:

FIG. 1 is a perspective view of a flush toilet, with the tank thereof open, and a bottle and suspending device embodying the principles of the invention, retaining the bottle in an inverted position in a toilet tank.

FIG. 2 is an enlarged view in perspective of the bottle of FIG. 1 in its storage position before use or installation. The cap is broken away to show a portion of the dispensing valve.

FIG. 3 is a fragmentary, further enlarged, exploded view in perspective showing the hanger and a portion of the liquid-dispensing bottle, prior to assembly.

FIG. 4 is an enlarged fragmentary view in section along the line 4—4 in FIG. 1.

DESCRIPTION OF A PREFERRED EMBODIMENT

In the drawings, FIG. 1 shows a liquid-dispensing bottle 10 suspended on a wall member 11, such as a wall of a toilet tank 12 as shown, by a hanger member 13 connected to the bottle 10.

As shown in FIG. 2, prior to its installation, the bottle 10 is normally stored or displayed upright. It has a bottom wall 14, four upright walls 15, 16, 17, and 18, and a neck 19 leading to an opening 20 containing a suitable dispensing valve 29, such as the one shown in U.S. Pat. No. 3,841,524. At this time the bottle is usually capped, by a cap 21, which is removed for installation, and the hanger member 13 is substantially flush with the wall 15, this wall 15 having a recess 22 for reception of the hanger 13.

FIG. 4 shows in sectional view the hanger member 13 in an extended position, pivoted outwardly from the bottle 10. The stored flush position of the hanger member 13 is shown in dashed lines. The recess 22 is shaped, as shown, to accommodate a lip or flange member 23 of the hanger 13, which extends at about right angles from the end of a generally planar portion 24. In the extended position, the lip 23 fits over the top edge 25 of the wall member 11, extending downwardly as shown, to prevent the bottle 10 from pulling away from the wall member 11 upon which it is suspended.

As indicated, the hanger member 13, in the extended position, is approximately parallel to and flush with the bottle's bottom wall 14, which is the upper end of the bottle 10 in the suspended, inverted position. This enables installation of a tank top 26 or other such cover, which normally rests on top of the wall member 11, to fit in place without any greater interference than the thickness of the planar main portion 24 of the hanger member causes, i.e., the bottle itself does not interfere with the placement of the cover 26.

The components 13 and 10 of the invention are shown prior to assembly in FIG. 3. As indicated, the lip means 23 may comprise a pair of separate depending flanges 27 and 28, for economy of material. Connected at the other end of the generally planar main portion 24 is a pivoted end portion 30, including a generally planar flange 31 stepped downwardly from the portion 24 by a transverse flange 32, a pair of vertical ribs 33 and 34 which act as a stop means for the extended position, and a pair of outwardly extending nipples 35 and 36. The nipples 35 and 36 fit into sockets 37 and 38 of the bottle 10.

The nipple sockets 37 and 38 are preferably simple depressions formed in parallel, spaced side walls 40 and 41 of the recess 22 of the bottle wall 15. Upon assembly, the hanger member 13 is simply pushed into place in the recess, whereupon the resilient plastic of the member 13 and of the bottle 10 yields and temporarily deforms to permit the nipples 35 and 36 to reach the sockets 37 and 38, at which point they snap into place. The sockets 37 and 38 of the bottle walls 40 and 41 exert a continuing axial force on the nipples 35 and 36, and the pivoted end portion 30 of the hanger member, so that a mild degree of frictional resistance to pivoting movement of the hanger member is afforded. This maintains the hanger member 13 in the stored position before the bottle is ready for use, and maintains it in the extended position when the bottle 10 is being moved toward placement on the wall member 11, adding to the convenience and efficiency of the apparatus.

As shown in FIGS. 2 and 3, the recess 22 includes a deeper groove or depression 42 for accommodating the lip means 23 of the hanger member in its stored position (in dashed lines in FIG. 4).

In the extended position, as shown in FIG. 4, the hanger member 13 is at about 90° rotation from its stored position. The stop ribs 33 and 34 are flat at their ends and abut against the surface 43 of the recess 23 of the bottle wall 15. Since these stop ribs 33 and 34 are above the horizontal axis of rotation of the hanger member, they prevent further pivoting movement of the member beyond the extended position shown.

There is preferably provided further structure for preventing forced over-pivoting of the hanger member 13, which would deform and damage the components as well as prevent proper suspension of the bottle on the wall member 11. This structure is best seen in FIG. 3, and comprises a pair of bulges or protrusions 44 and 45 formed on the walls 40 and 41 at the outer corners of the recess 22. If the hanger member 13 is forced a few degrees of rotation beyond its normal fully-extended position, the edges of the planar flange 31 contact the protrusions 44 and 45, arresting further rotation. Thus, it would take a considerable amount of deliberate force to pivot the hanger signficantly beyong the intended 90° extended position.

The above described preferred embodiment provides a dispenser bottle suspending device which is relatively simple, easily and economically manufactured and assembled, compact in storage and convenient to operate. Various other embodiments and variations to this preferred embodiment will be apparent to those skilled in the art and may be made without departing from the spirit and scope of the following claims.

We claim:

1. A liquid-dispensing assembly, comprising:

a plastic bottle having a flat bottom wall, vertical side walls, and a dispensing valve at its upper end, adapted to dispense liquid contained in said bottle when said bottle is inverted, one side wall and said bottom wall of said bottle being formed to provide an inset recess in said one side wall extending to said bottom wall, said recess including two facing side wall portions with an inset wall between them, and a pair of pivot receptacles horizontally opposite each other in the facing side wall portions adjacent and spaced up from the bottom end of said recess, a hanger, comprising a flat main bottle-support portion, lip means generally perpendicular to said flat portion at one end thereof, cooperating flange means generally perpendicular to said flat portion at the other end of the flat portion, a pair of opposed pivot nipples on a horizontal axis at the opposite end of the hanger from the lip means, on the other side of the flange from the flat portion and offset from the plane of the flat portion, inwardly with respect to the recess, said pivot nipples being engaged in said pivot receptacles, and stop means on the hanger for engaging the inset wall of the recess in abutting relation to the vertical plane of the inset wall when the hanger is in extended position with the flat portion approximately perpendicular to the bottle side wall and approximately parallel to the bottom wall, and for preventing further pivotal movement of said hanger from the extended position, said stop means being positioned above the axis of the pivot nipples when the bottle is inverted and the hanger is extended, and extending up to a position approximately flush with the flat portion of the hanger and with the bottom wall of the bole, said hanger when pivoted into a stored position lying in said recess substantially flush with said one side wall.

2. A suspending device for a liquid-dispensing plastic bottle having side walls and a bottom wall and adapted to dispense liquid out its top while suspended in inverted position, comprising:

a hanger member for suspending the bottle over the top of a wall member aginst which the bottle is to be positioned, one bottle side wall shaped to provide a recess in the side wall, extending to the bottom wall and having an inset wall spaced inwardly in the side wall, enabling substantially flush storage of the hanger member in the bottle side wall prior to installation of the bottle in its dispensing position, pivotal mounting means associated with the hanger member and a wall of the bottle for pivotally mounting the hanger member on the bottle wall for rotation about a horizontal axis from a stored flush position to an outwardly extended position generally perpendicular to the bottle wall, said horizontal axis being positioned in the recess and spaced inwardly from both the bottom wall and said one side wall, limit means for limiting the outward rotation of the hanger member to said generally perpendicular extended position, comprising an abutment on the hanger member positioned to engage the inset wall of the recess, abutting the inset wall in the horizontal direction when the hanger is in the extended position, said abutment being positioned above the horizontal axis when the bottle is inverted and the hanger is extended, abutting the inset wall of the recess at a position approximately flush with the bottom wall of the bottle, and lip means on the outer end of the extended hanger member, extending generally parallel to the bottle side wall for holding the bottle close to said wall member.

3. The suspending device of claim 2 wherein said pivotal mounting means comprises opposed generally parallel surfaces partially defining said recess of the bottle wall and having a pair of opposed, spaced apart sockets along said horizontal axis, and a pair of opposed nipples on the hanger member extending into the sockets.

4. The suspending device of claim 3 wherein said bottle and hanger member are of resilient plastic, said nipples extending only a short distance into the sockets, whereby the hanger member may be assembled with the bottle by pushing it into position in the sockets, temporarily deforming at least one of the hanger members and the bottle.

5. The suspending device of claim 4 wherein the nipples are engaged tightly against the sockets, forming a degree of frictional resistance to rotation of the hanger member so that it tends to stay in the stored position when stored and in the extended position when extended.

6. The suspending device of claim 2 wherein said abutment comprises a pair of stop ribs at the pivoted end of the hanger member, having flat surfaces extending above the horizontal pivot axis in the extended position of the hanger member, said flat surfaces being engaged against the inset wall in said extended position.

7. The suspending device of claim 6 wherein said limit means for limiting the outward rotation of the hanger member further includes a pair of protrusions in the recess of the bottle wall positioned to interfere with pivotal movement of the hanger member beyond the normal extended position.

8. The suspending device of claim 2 wherein the hanger member comprises a generally planar main portion which is generally parallel to the bottle wall in the stored position and adapted to rest on the top edge of said wall member in the extended position, said lip means being attached to the outer end of the main portion, generally perpendicular thereto, and a pivoted end portion attached to the inner end of the main portion.

9. The suspending device of claim 8 wherein the pivoted end portion comprises a generally planar flange parallel to and stepped inwardly from the main portion, connected to the main portion by a transverse flange, a pair of nipples on said horizontal axis and extending in opposite directions from said generally planar flange, near the end thereof, forming a part of said pivotal mounting means, said abutment comprising at least one stop rib positioned on the planar flange, extending from the transverse flange to the end of the planar flange in a plane generally perpendicular to the planes of the main portion and the planar flange and having a flat surface adjacent to the end of the planar flange, positioned to be in abutting contact against the inset wall when the hanger member is extended.

10. The suspending device of claim 9 wherein said means for limiting the outward rotation of the hanger member includes a pair of protrusions in the recess of the bottle wall positioned to engage the edges of the generally planar flange when the hanger member is forced beyond its normal extended position, thereby limiting said forced rotation.

* * * * *